US008684551B2

(12) United States Patent
AlSaffar

(10) Patent No.: US 8,684,551 B2
(45) Date of Patent: Apr. 1, 2014

(54) LIGHTING ASSEMBLY IN THE FORM OF A PALM TREE

(76) Inventor: Abdulreidha A. AlSaffar, Mubarak Al Kabir (KW)

( * ) Notice: Subject to any disclaimer, the term of this patent is extended or adjusted under 35 U.S.C. 154(b) by 188 days.

(21) Appl. No.: 13/253,418

(22) Filed: Oct. 5, 2011

(65) Prior Publication Data

US 2013/0088858 A1 Apr. 11, 2013

(51) Int. Cl.
*F21S 6/00* (2006.01)

(52) U.S. Cl.
USPC ..... 362/123

(58) Field of Classification Search
USPC ..... 362/122–123, 249.18, 249.19
See application file for complete search history.

(56) References Cited

U.S. PATENT DOCUMENTS

| | | | | |
|---|---|---|---|---|
| 2,066,631 | A | 1/1937 | Gorre | |
| 3,974,372 | A | 8/1976 | Cochran | |
| 4,617,768 | A | 10/1986 | Gebelius | |
| 5,106,101 | A * | 4/1992 | McKay | 473/492 |
| D348,232 | S | 6/1994 | Mauk | |
| 5,704,580 | A | 1/1998 | Peery, Jr. | |
| 6,030,670 | A | 2/2000 | Chang | |
| 6,596,353 | B1 * | 7/2003 | Turner | 428/18 |
| 6,599,591 | B1 * | 7/2003 | Scott | 428/18 |
| 6,851,838 | B2 | 2/2005 | Haddad et al. | |
| 6,869,198 | B1 * | 3/2005 | Garza, Saul | 362/123 |
| 7,090,382 | B2 | 8/2006 | Haddad et al. | |
| 2006/0146515 | A1 * | 7/2006 | Hwang et al. | 362/84 |
| 2007/0041189 | A1 * | 2/2007 | Mchinnis et al. | 362/252 |

* cited by examiner

*Primary Examiner* — Robert May
(74) *Attorney, Agent, or Firm* — Lowe Hauptman & Ham, LLP

(57) ABSTRACT

A lighting assembly in the form of a palm tree as a decorative and ornamental street light includes an upwardly extending shaft, a base and a mechanism for fixing and anchoring the shaft in a selected location. The base includes a plurality of downwardly extending rods and a mass of concrete around and in between the rods to anchor the assembly. The upwardly extending shaft also includes a bark like outer cover and a plurality of outwardly extending limbs in the form of a palm tree. A plurality of lights illuminating an area around the assembly, the tree limbs including fronds.

1 Claim, 6 Drawing Sheets

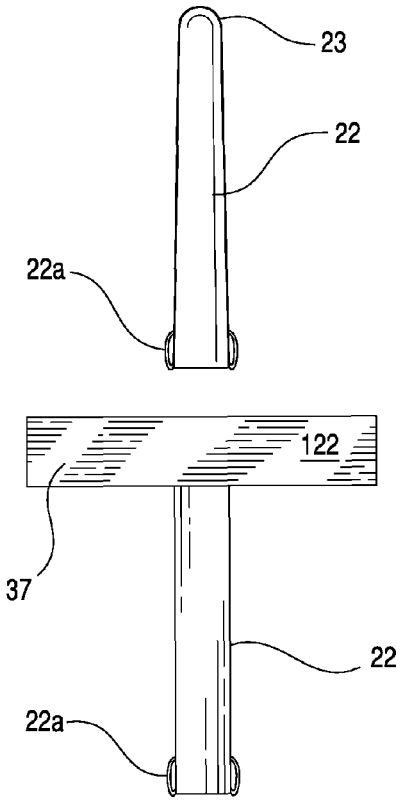
FIG. 7
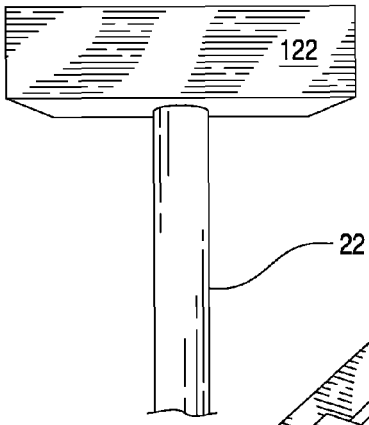
FIG. 8
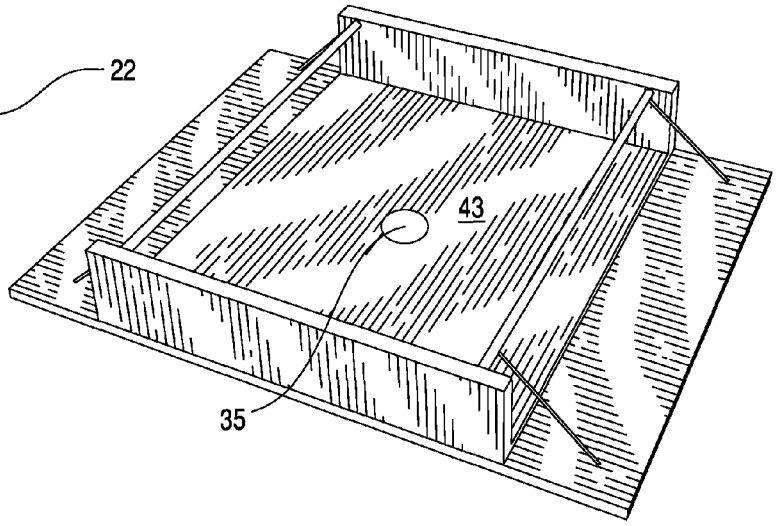

LIGHTING ASSEMBLY IN THE FORM OF A PALM TREE

FIELD OF THE INVENTION

This invention relates to an ornamental lighting assembly and more particularly to an ornamental lighting assembly for a street light or the like in the form of a palm tree.

BACKGROUND OF THE INVENTION

Ornamental lighting standards and poles are well known and have been in widespread use for many years. For example, a U.S. Pat. No. 3,974,372 of Cochran for a lighting standard issued on Aug. 10, 1976. As disclosed therein a plurality of ornamental lighting standard shell parts are stacked one upon the other around a ground anchored inner pole. The shell includes a base portion enlarged relative to an adjacent portion of the pole and is capable of shifting laterally a slight amount in the event that it is struck by a vehicle. An intermediate portion of the shell is constructed of a plurality of replaceable parts for easy installation and replacement. The shell also includes ornamental parts as well as lamp assemblies.

A more recent U.S. Pat. No. 5,704,580 of Peery, Jr. for removable rings for assembling an ornamental base to a street pole. As disclosed a method and apparatus for assembling a street pole to a standard sized base includes the step of selecting a street pole of a predetermined configuration. Encircling portions, preferably rings consisting of two semi-circular portions, each having a nestable section with each other and a complementary section with the selected street pole are provided. The encircling portions are nested together on the standard sized base to connect the standard size base to the selected street pole thereby continuing the appearance finish of the standard size base while preventing unauthorized access to an interior of the standard sized base. The apparatus includes encircling portions to connect the standard sized base to the selected street pole.

Finally a U.S. Pat. No. 6,030,670 of Chang discloses a decorating tree with an embellishing lamp. As disclosed an artificial decorated tree with embellishing lamp is provided which includes several hollow joints, sockets, connectors, branches, embellishing lamps and a set of electric cords. The decorating tree is assembled with plug-in joints and internal wiring coupled to lamps supported from branches, thereby avoiding the use of exposed light strings external to the artificial tree structure.

Notwithstanding the above, it is presently believed that there is a potential commercial market for an ornamental lighting assembly in accordance with the present invention. There should be a demand for such lighting assemblies because they have a particularly pleasing appearance and can be manufactured and installed at a reasonable cost. Such assemblies include a sturdy base, bright lights for illumination and colored lights for a particular pleasing appearance and branches of two sizes. Further the assembly may be constructed with heights of up to between 18 and 25 meters and may include separate circuits for illuminating separate portions of the ornamental light assemblies.

BRIEF SUMMARY OF THE INVENTION

In essence, the present invention contemplates a lighting assembly in the form of a palm tree for use as a decorative/ornamental street lamp. The lighting assembly comprises or consists of an upwardly extending shaft, a base for supporting and anchoring the base and the shaft in a preselected location. Means are also provided for fixing the shaft in an upwardly extending position on the base. Further an electrical conductor and a first opening in the base under the shaft allows the electrical conductor to pass through the base and upwardly into the shaft. The base includes a generally horizontally disposed steel plate, a plurality of openings around the shaft and a plurality of downwardly extending rods having a threaded end and means including nuts welded to an upward surface of the steel plate for fixing each of the rods to the plate with each rod extending downwardly through the plate. The upwardly extending shaft includes a plurality of inner steel tubular sections stacked one upon the other to provide a generally smooth upwardly extending shaft with decreasing diameters and a plurality of outer tubular shafts stacked one upon the other with the appearance of the bark of a palm tree fitting around the inner tubular shaft and in relatively close proximity fitting generally closely against the shaft. Further a plurality of upwardly extending plant like elements are disposed at and around the base and wherein each of the upwardly extending plant like elements is in the form of plant growth at or near the base of a natural palm tree. Further a plurality of radially extending branches including a plurality of generally upward and outwardly extending shorter branches each of which includes numerous leafy fronds in an upper portion of the tree and an array of coconuts attached to the shaft immediately below the branches. Finally a first group of lights are disposed within and illuminate the coconuts in the surrounding area while a second group of lights are disposed on the branches and illuminate the branches. The second group of lights are relatively small and may be provided in various colors. The smaller lights may be LEDs and generally include one light colored LED at the end of each branch.

The lighting assembly will now be described in connection with the accompanying drawings wherein like reference numerals have been used to identify like parts.

DESCRIPTION OF THE DRAWINGS

FIG. 7 is a schematic illustration of an upwardly extending shaft with a stacking arrangement at various levels;

FIG. 8 is a perspective view of a box like arrangement for internal electrical installations;

DESCRIPTION OF THE PREFERRED EMBODIMENTS OF THE INVENTION

Figure 1:
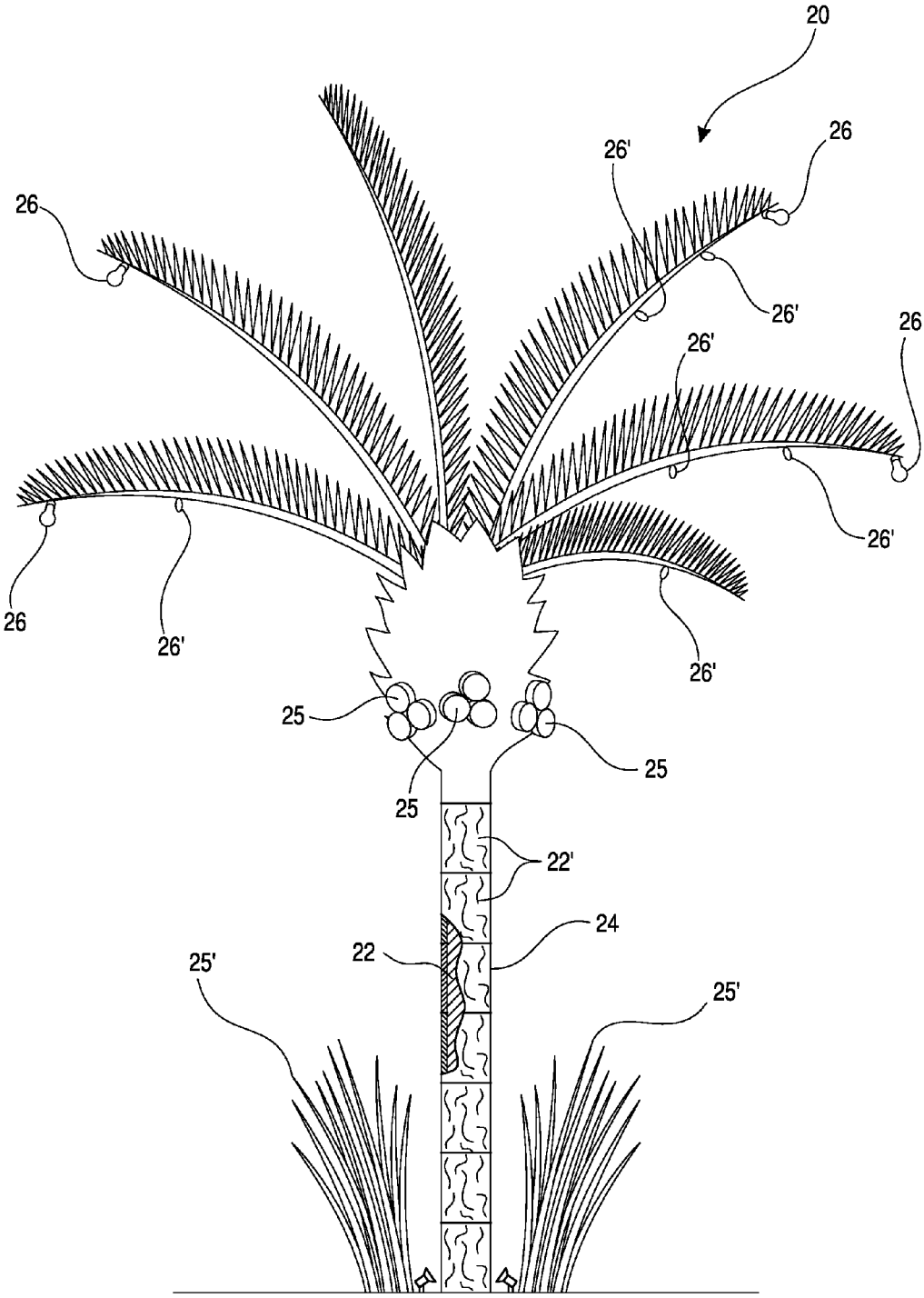
FIG. 1 is a schematic illustration of a lighting assembly in the form of a palm tree in accordance with a first embodiment of the invention.
Figure 2:
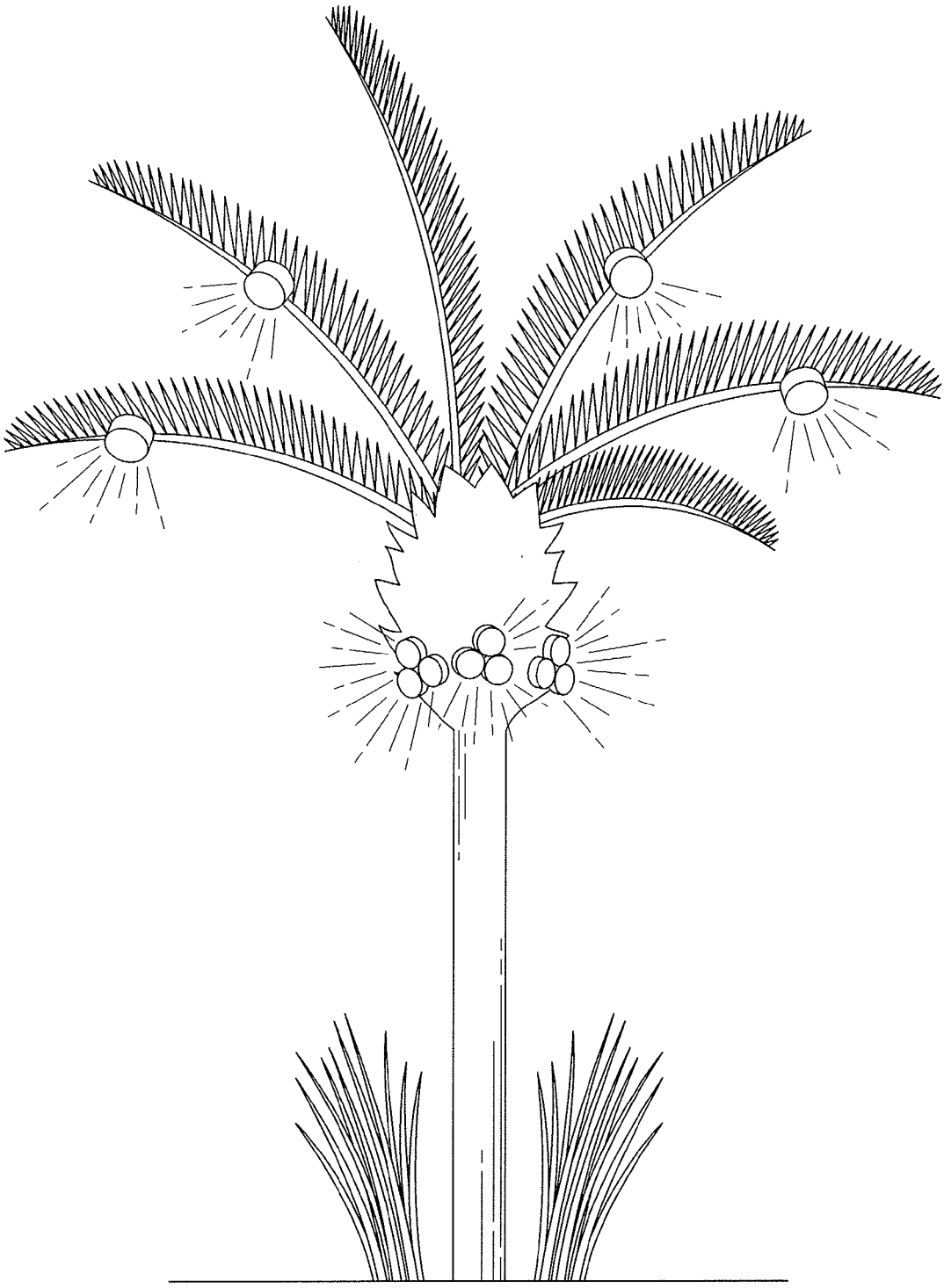
FIG. 2 is a schematic illustration of a lighting assembly shown in FIG. 1 but with an arrangement of lights.

As shown in FIGS. 1 and 2 a lighting assembly 20 in the form of a palm tree for use as an ornamental street light includes an upwardly extending shaft 22. The upwardly extending shaft includes an upper cone shaped top portion 23 and a lower portion 24 that resembles the bark of a palm tree. As shown in FIGS. 1 and 2 a plurality of upwardly extending plant like elements 25' surround the base or bottom of the upwardly extending shaft 22.

The upwardly extending shaft 22 includes the upper portion 23 in the shape of a frustum of a cone with a decreasing diameter or radius from the bottom to the top and a rounded top. The lower portion 24 has a relatively rough outer surface similar to the bark of a palm tree and in a similar color. In the preferred embodiment of the invention, the upwardly extending shaft includes an inner shaft 22 and an outer shaft 22'. The inner shaft 22 is preferably made of metal such as iron or steel while the outer shaft 22' is made of plastic sections that fit over the inner shaft 22 or sections thereof and fits snugly thereagainst.

The upwardly extending shaft 22 has a height of up to about 18-25 meters with a diameter of at least about 45 cm and at its top of about 30 cm. It is also contemplated that a shorter tree with shorter limbs may be provided in appropriate areas.

The lighting assembly 20 also includes a number of lamps including a plurality of downwardly directing lamps 25 for illuminating an area surrounding the assembly including a street, sidewalk and the like. In addition, in one embodiment of the invention a white or yellow incandescent lamp 26 is disposed at the outer end of each branch or limb at least on the branches at a first level by a plurality of lower intensity bulbs or LEDs of different colors are disposed along the branches. Lower wattage bulbs may also be disposed around a plurality of coconuts 24 and the upwardly extending plant like elements for a more pleasing appearance.

A first embodiment of the invention includes a base or plate 30 for the street light or the like and a downwardly directed lattice structure 31 of generally rectangular openings for embedding with uncured concrete. The lattice structure can extend downwardly for up to about five meters for a 25 meter tree located in an area susceptible to high winds.

Figure 3:
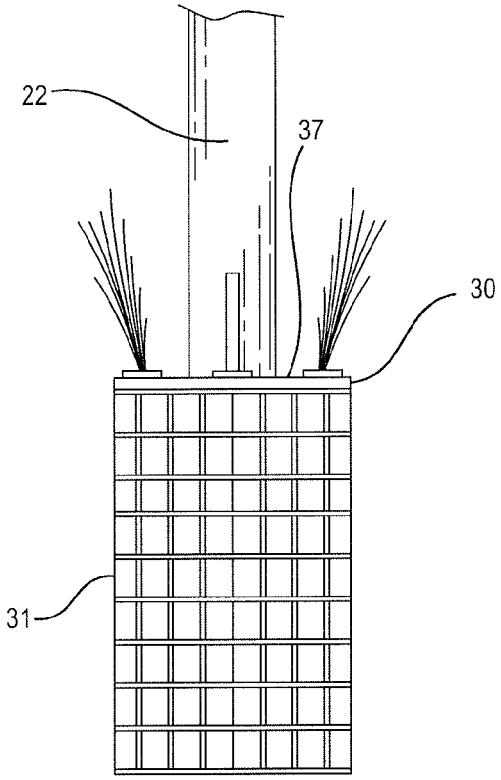
FIG. 3 is a side elevational view of a base for supporting a lighting assembly in accordance with a second embodiment of the invention.

With respect to trees of low height and/or areas that are not likely to be hit by hurricanes the lattice structure may extend down for a distance of about 1½ meters and with a width of the concrete block of about the same dimensions. As shown in FIG. 3 an upwardly extending inner shaft 22 is of a smaller diameter and made of iron or steel.

Figure 4:
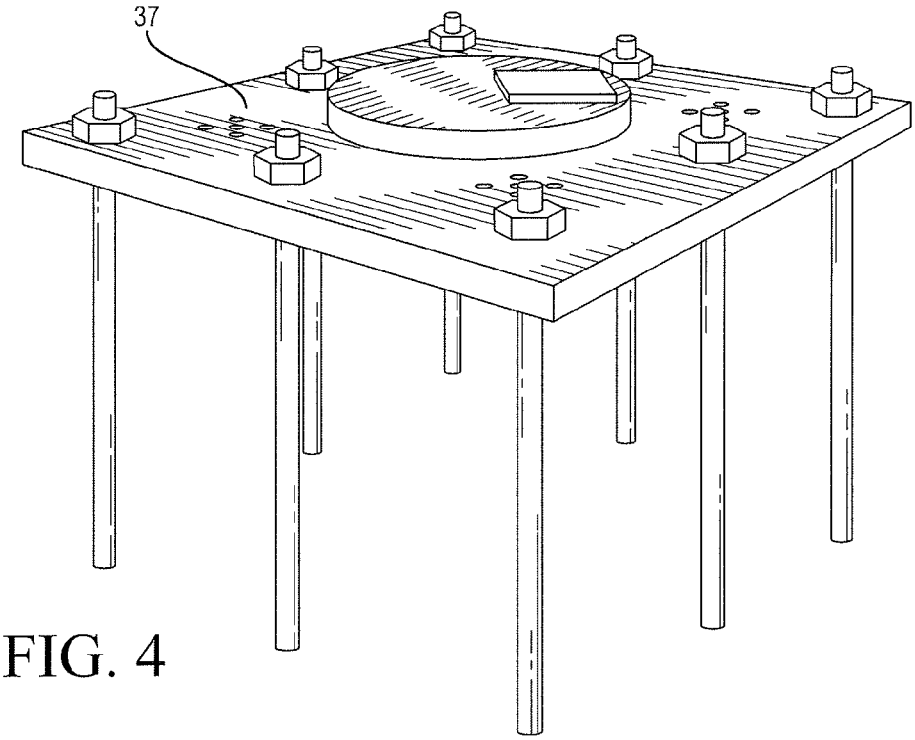
FIG. 4 is a perspective view of a base for supporting a lighting assembly in accordance with a third embodiment of the invention.

A second embodiment of the invention is illustrated in FIG. 4 includes a base for the assembly 20 includes a generally horizontal steel plate 30 that is positioned around by eight downwardly directed steel rods 29 with a threaded upper end. The steel plate 30 also includes a number of threaded openings for receiving the threaded portion of the steel rods 29. In addition a locking nut 29' may be threaded onto an upper portion of the rods 29 and subsequently welded to the plate 30.

Figure 5:
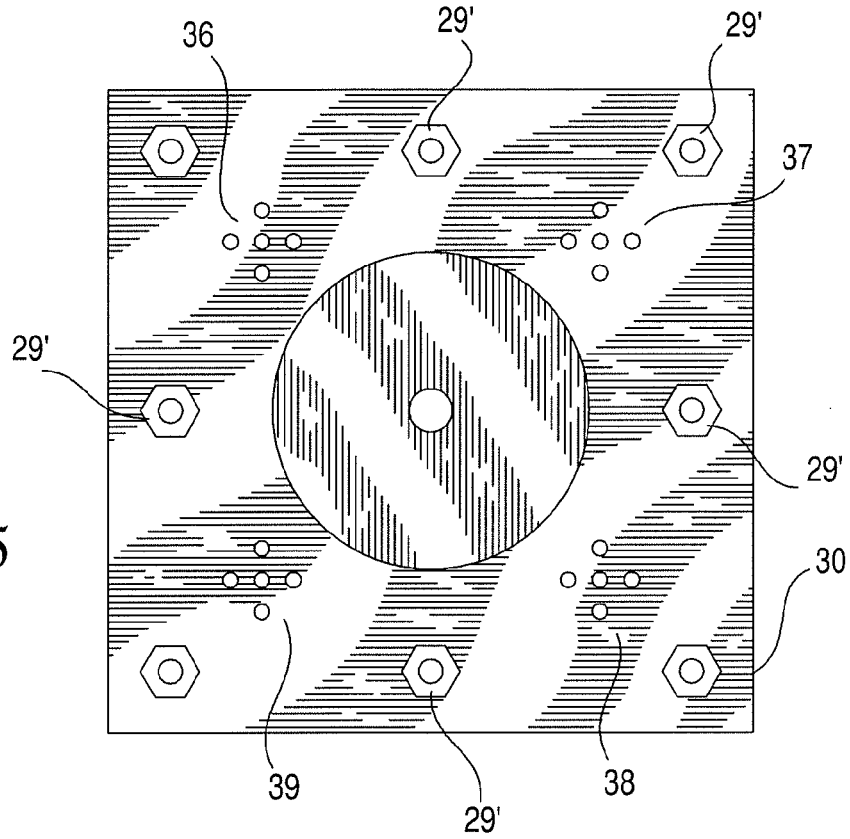
FIG. 5 is a top or planned view of an upper surface of a base showing an outline of an upwardly extending portion.

As illustrated more clearly in FIG. 5 a generally horizontal steel plate 30 upon which the upwardly extending shaft is disposed. The plate 30 also includes a generally circular opening 35 which allows an electrical wire or cable to be threaded inside of the upwardly extending shaft 22 for providing electricity to power the array of lights. The wire or cable is connected to a source of electricity through a switch or the like for turning a plurality of the light assemblies on during a period of darkness and turning them off during the daylight hours. In addition, the steel plate 30 may have a circular or square mounting plate 36 and 37 that each include a plurality of openings upon which to fix means for supporting upwardly extending plant like elements and that appear to be plant growth surrounding a palm tree, two additional areas 38 and 39 are provided for additional plants that surround the tree.

Figure 6:
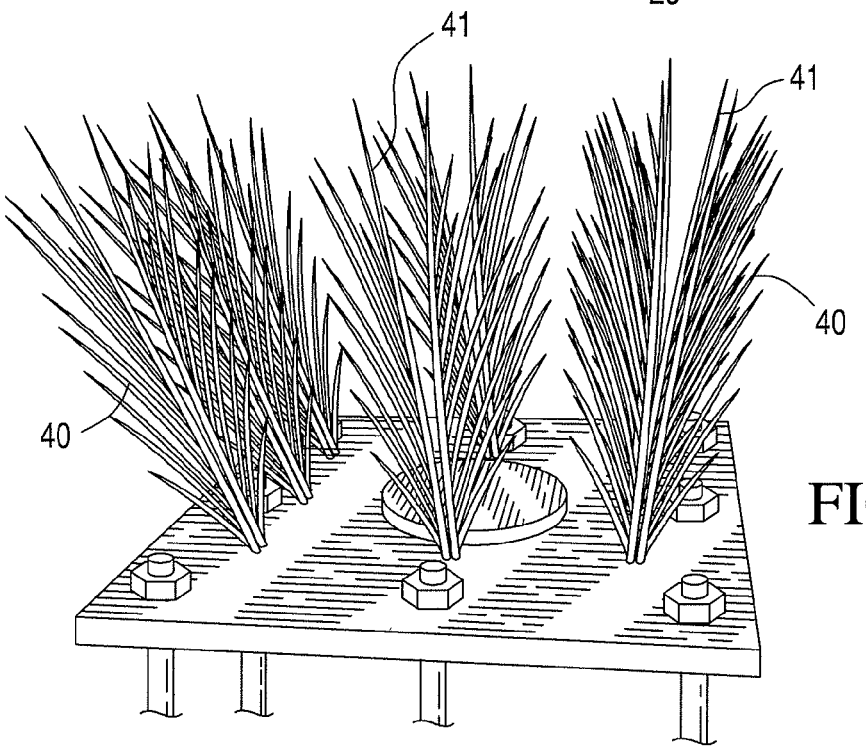
FIG. 6 is a perspective view of the base shown in FIG. 5 but with a plurality of small upwardly extending plants around the portion of the upwardly extending shaft.

A plurality of relatively lower upwardly extending plates 40 are fixed to the plate 30 in a conventional manner as shown in FIG. 6 and merely each contain one or more light bulbs 41 of relatively low intensity.

FIG. 7 illustrates several portions of the upwardly extending shaft 22 wherein each section includes a slightly enlarged bottom portion 22*a* for fitting over an upper or top portion of a lower section 122. The box like containers 122 are schematic illustrations of an enclosure for containing wiring that comes together for contact with a central cable so that electric current flows to electric light bulbs at that level and/or LEDs at that level.

FIG. 8 shows a typical example of an enclosure shown in FIG. 7. As shown, the enclosure includes a base 43 and upwardly extending walls 35 wherein a top is not shown.

Figure 9:
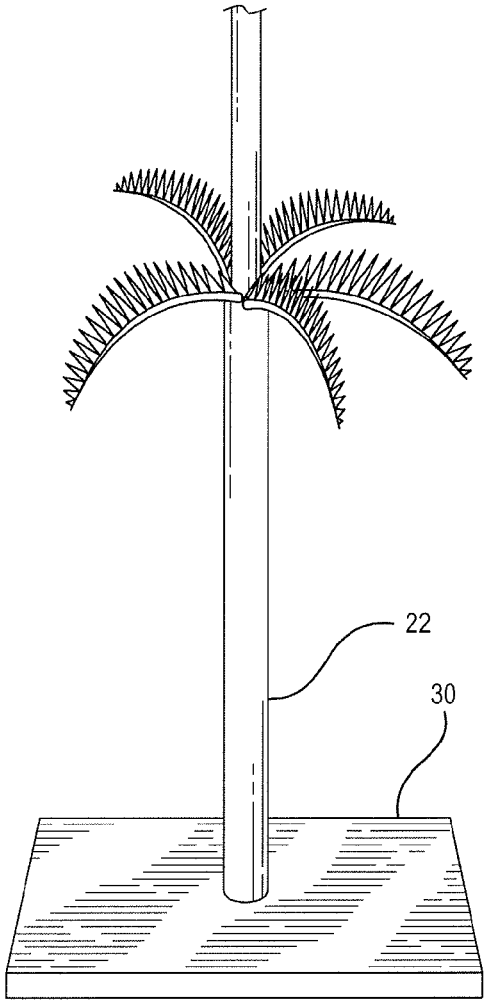
FIG. 9 is a schematic view of an upwardly extending shaft, a base, and a layer of branches.
Figure 10:
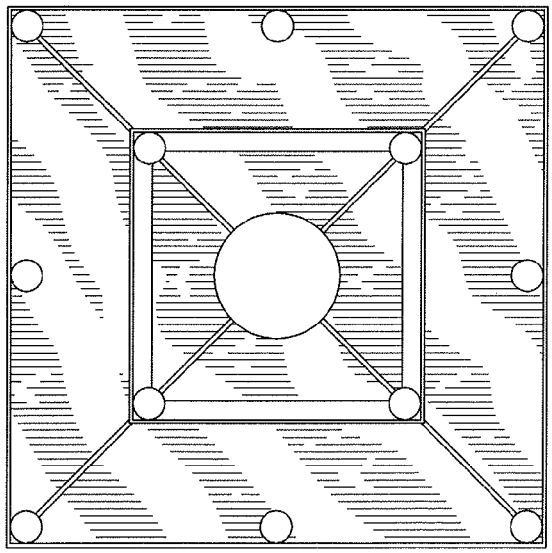
FIG. 10 is a top or plan view of an outwardly extending support including a plurality of lights.

FIG. 9 shows a light assembly 20 that includes an upwardly extending shaft 22 including a base plate 30 and a lower level of outwardly extending branches. As illustrated in FIG. 10, each layer of branches may include a wire-like support structure 50 upon which the branches rest. A plurality of lights 51 are illustrated as being disposed on various branches and shown as an example of their place along a support structure.

While the invention has been described in connection with its preferred embodiments it should be recognized that changes and modifications may be made therein without departing from the scope of the appended claims.

What is claimed is:

1. A lighting assembly in the form of a palm tree for serving as a decorative and ornamental street lighting assembly consisting of:

an upwardly extending shaft with an upper portion in the shape of a frustum of a cone with a decreasing radius from the bottom to the top and a rounded top, a base for supporting and anchoring said base and said shaft in a preselected location and means for fixing said shaft in an upwardly extending position on said base, an electrical conductor and a first opening in said base under said shaft for allowing said electrical conductor to pass through said base and into said shaft;

said base including a generally horizontally disposed steel plate, a plurality of openings around said shaft and eight downwardly extending rods having a threaded upper end and a plurality of nuts welded to an upper surface of said steel plate for fixing each of said rods to said plate with each rod extending through said plate;

said upwardly extending shaft including a plurality of inner steel tubular sections stacked one upon the other to provide a smooth upwardly extending shaft with decreasing tapered diameters with an upper surface of a lower section fitting together with a lower surface of an adjacent section, and a plurality of outer tubular plastic shafts stacked one upon the other with the appearance of the bark of a palm tree fitting around said tubular steel shaft in relatively close fitting contact therewith;

a plurality of upwardly extending plant like elements at and around said base and wherein each of said upwardly extending plant like elements is in the form of plants growing at or near the base of a natural palm tree;

a plurality of radially extending branches including a plurality of generally upwardly and outwardly extending shorter branches each of which include numerous leafy fronds in an upper portion of said shaft and an array of coconuts around said shaft immediately below said branches; and a first group of relatively bright lights disposed around said shaft for illuminating an area around said assembly and a second group of relatively low intensity multicolored LED lights disposed near an outer portion of said branches for illuminating said outer portion of said branches;

a source of electricity and means for connecting said electrical conductor to said source of electricity and switch means for illuminating said lights during hours of darkness and turning off said lights during daylight.

* * * * *